US008846598B2

(12) United States Patent
Lant et al.

(10) Patent No.: US 8,846,598 B2
(45) Date of Patent: Sep. 30, 2014

(54) COMPOSITION COMPRISING A CELLULASE AND A BLEACH CATALYST

(75) Inventors: Neil Joseph Lant, Newcastle upon Tyne (GB); Gregory Scot Miracle, Hamilton, OH (US); Philip Frank Souter, Northumberland (GB)

(73) Assignee: The Procter & Gamble Company, Cincinnati, OH (US)

( * ) Notice: Subject to any disclaimer, the term of this patent is extended or adjusted under 35 U.S.C. 154(b) by 185 days.

(21) Appl. No.: 11/825,755

(22) Filed: Jul. 9, 2007

(65) Prior Publication Data

US 2010/0261635 A1 Oct. 14, 2010

Related U.S. Application Data

(60) Provisional application No. 60/819,155, filed on Jul. 7, 2006.

(51) Int. Cl.

| | |
|---|---|
| ***C11D 3/386*** | (2006.01) |
| ***C11D 3/34*** | (2006.01) |
| ***C11D 3/395*** | (2006.01) |
| ***C11D 3/39*** | (2006.01) |

(52) U.S. Cl.

CPC ..... *C11D 3/38636* (2013.01); *C11D 3/349* (2013.01); *C11D 3/3927* (2013.01); *C11D 3/38645* (2013.01); *C11D 3/3905* (2013.01); *C11D 3/3932* (2013.01)

USPC ..... 510/392; 510/374; 510/494; 435/209

(58) Field of Classification Search

IPC ..... C11D 3/3927,3/38645, 3/349; C12N 9/2437

See application file for complete search history.

(56) References Cited

U.S. PATENT DOCUMENTS

| | | | |
|---|---|---|---|
| 4,678,792 | A | 7/1987 | Nickl et al. |
| 5,045,223 | A | 9/1991 | Batal et al. |
| 5,047,163 | A | 9/1991 | Batal et al. |
| 5,360,568 | A | 11/1994 | Madison et al. |
| 5,360,569 | A | 11/1994 | Madison et al. |
| 5,370,826 | A | 12/1994 | Madison et al. |
| 5,442,066 | A | 8/1995 | Madison et al. |
| 5,478,357 | A | 12/1995 | Madison et al. |
| 5,482,515 | A | 1/1996 | Madison et al. |
| 5,550,256 | A | 8/1996 | Madison et al. |
| 5,653,910 | A | 8/1997 | Kerschner et al. |
| 5,710,116 | A | 1/1998 | Miracle et al. |
| 5,760,222 | A | 6/1998 | Coope |
| 5,785,886 | A | 7/1998 | Kerschner et al. |
| 5,952,282 | A | 9/1999 | Loffler et al. |
| 6,042,744 | A | 3/2000 | Nation et al. |
| 7,033,981 | B2 | 4/2006 | Hakamada et al. |
| 2005/0215450 | A1 | 9/2005 | Outtrup et al. |

FOREIGN PATENT DOCUMENTS

| | | | |
|---|---|---|---|
| EP | 0265832 | B1 | 10/1993 |
| EP | 0728183 | B1 | 3/1998 |
| EP | 0728181 | B1 | 3/1999 |
| EP | 0 775 192 | B1 | 8/2001 |
| WO | WO 95/13351 | | 5/1995 |
| WO | WO 95/13353 | | 5/1995 |
| WO | WO 97/01629 | A | 1/1997 |
| WO | WO 97/10323 | | 3/1997 |
| WO | WO 98/16614 | | 4/1998 |
| WO | WO 00/42151 | A1 | 7/2000 |
| WO | WO 00/42156 | A1 | 7/2000 |
| WO | WO 01/16110 | A1 | 3/2001 |
| WO | WO 01/16263 | A2 | 3/2001 |
| WO | WO 01/16273 | A1 | 3/2001 |
| WO | WO 01/16274 | A1 | 3/2001 |
| WO | WO 01/16275 | A1 | 3/2001 |
| WO | WO 01/16276 | A1 | 3/2001 |
| WO | WO 01/16277 | A1 | 3/2001 |
| WO | WO 02/099091 | A3 | 12/2002 |
| WO | WO 2004/053039 | A2 | 6/2004 |
| WO | 2004/074419 | * | 9/2004 |
| WO | 2005/047264 | * | 5/2005 |

OTHER PUBLICATIONS

PCT International Search Report Dated Jul. 7, 2006—5 pgs.

* cited by examiner

*Primary Examiner* — Rebecca Prouty
(74) *Attorney, Agent, or Firm* — Melissa G. Krasovec

(57) ABSTRACT

The present invention relates to a composition comprising: (i) a bacterial alkaline enzyme exhibiting endo-beta-1,4-glucanase activity (E.C. 3.2.1.4); and (ii) a bleach catalyst that is capable of accepting an oxygen atom from a peroxyacid and transferring the oxygen atom to an oxidizeable substrate.

11 Claims, No Drawings

COMPOSITION COMPRISING A CELLULASE AND A BLEACH CATALYST

CROSS REFERENCE TO RELATED APPLICATION

This application claims the benefit of U.S. Provisional Application No. 60/819,155, filed Jul. 7, 2006.

FIELD OF THE INVENTION

The present invention relates to a composition comprising a bacterial alkaline enzyme exhibiting endo-beta-1,4-glucanase activity (E.C. 3.2.1.4) and a bleach catalyst. More specifically, the present invention relates to composition comprising such endoglucanase and a bleach catalyst that is capable of accepting an oxygen atom from a peroxyacid and transferring the oxygen atom to an oxidizeable substrate. The compositions of the present invention are typically suitable for use as laundry detergent compositions.

BACKGROUND OF THE INVENTION

Cellulase enzymes have been used in detergent compositions for many years now for their known benefits of depilling, softness and colour care. However, the use of most of cellulases has been limited because of the negative impact that cellulase may have on the tensile strength of the fabrics' fibers by hydrolysing crystalline cellulose. Recently, cellulases with a high specificity towards amorphous cellulose have been developed to exploit the cleaning potential of cellulases while avoiding the negative tensile strength loss. Especially alkaline endo-glucanases have been developed to suit better the use in alkaline detergent conditions.

For example, Novozymes in WO02/099091 discloses a novel enzyme exhibiting endo-beta-glucanase activity (EC 3.2.1.4) endogenous to the strain *Bacillus* sp., DSM 12648; for use in detergent and textile applications. Novozymes further describes in WO04/053039 detergent compositions comprising an anti-redeposition endo-glucanase and its combination with certain cellulases having increased stability towards anionic surfactant and/or further specific enzymes. Kao's EP 265 832 describes novel alkaline cellulase K, CMCase I and CMCase II obtained by isolation from a culture product of *Bacillus* sp KSM-635. Kao further describes in EP 1 350 843, alkaline cellulase which acts favourably in an alkaline environment and can be mass produced readily because of having high secretion capacity or having enhanced specific activity.

Detergent manufacturers have also attempted to incorporate bleach catalysts, especially oxaziridium or oxaziridinium-forming bleach catalysts, in their detergent products in an attempt to provide a good bleaching performance. EP 0 728 181, EP 0 728 182, EP 0 728 183, EP 0 775 192, U.S. Pat. No. 4,678,792, U.S. Pat. No. 5,045,223, U.S. Pat. No. 5,047,163, U.S. Pat. No. 5,360,568, U.S. Pat. No. 5,360,569, U.S. Pat. No. 5,370,826, U.S. Pat. No. 5,442,066, U.S. Pat. No. 5,478,357, U.S. Pat. No. 5,482,515, U.S. Pat. No. 5,550,256, U.S. Pat. No. 5,653,910, U.S. Pat. No. 5,710,116, U.S. Pat. No. 5,760,222, U.S. Pat. No. 5,785,886, U.S. Pat. No. 5,952,282, U.S. Pat. No. 6,042,744, WO95/13351, WO95/13353, WO97/10323, WO98/16614, WO00/42151, WO00/42156, WO01/16110, WO01/16263, WO01/16273, WO01/16274, WO01/16275, WO01/16276, WO01/16277 relate to detergent compositions comprising an oxaziridium and/or an oxaziridinium-forming bleach catalyst.

The inventors have found that the combination of alkaline bacterial endoglucanases with certain oxaziridinium-forming bleach catalysts leads to a surprising improvement in cleaning and whitening performance. Without wishing to be bound by theory, it is believed that the following mechanisms are likely to give rise to such benefits: the endoglucanase enzyme hydrolyses amorphous cellulose present on the cotton surface, opening up the pore structure of the fabric making it more accessible to the oxaziridinium-forming bleach chemistry. In addition, by working on yellow soils by both removal (alkaline bacterial endoglucanase) and bleaching (oxaziridinium-forming bleach), an improvement in cleaning perception is achieved. It is also believed that the combination of oxaziridinium-forming bleach chemistry with alkaline bacterial endoglucanase leads to enhanced performance of fluorescent whitening agents by the removal of soils that would otherwise inhibit the deposition and/or fluorescence yield of these materials.

The inventors have found that appropriate selection of alkaline bacterial endoglucanase and oxaziridinium-forming bleach allows to maximise the benefits and minimise negative interactions such as oxidative decomposition of the cellulase during the wash process or during storage.

SUMMARY OF THE INVENTION

The present invention provides a composition comprising: (i) a bacterial alkaline enzyme exhibiting endo-beta-1,4-glucanase activity (E.C. 3.2.1.4); and (ii) a bleach catalyst that is capable of accepting an oxygen atom from a peroxyacid and transferring the oxygen atom to an oxidizeable substrate.

SEQUENCE LISTING

SEQ ID NO: 1 shows the amino acid sequence of an endoglucanase from *Bacillus* sp. AA349 SEQ ID NO: 2 shows the amino acid sequence of an endoglucanase from *Bacillus* sp KSM-S237

DETAILED DESCRIPTION OF THE INVENTION

Composition

The composition comprises: (i) a bacterial alkaline enzyme exhibiting endo-beta-1,4-glucanase activity (E.C. 3.2.1.4); and (ii) from 0.0005% to 0.1% of a bleach catalyst that is capable of accepting an oxygen atom from a peroxyacid and transferring the oxygen atom to an oxidizeable substrate.

The composition of the present invention will preferably comprise a source of peracid. Such peracid source can be already present onto the wash load or in the wash solution via for example an additive or a pre-treatment. The source of peracid can be either in the form of an activated bleach system comprising a bleach activator and source of peroxide, or of a preformed peracid, or of a diacyl peroxide/lipase bleach system, and/or a tetra-acyl peroxide/lipase bleach system.

Preferred activated bleach systems comprise (i) from 0% to less than 15%, preferably to 7%, or to 4%, or from 1%, or from 1.5%, by weight of the composition, of tetraacetylethylenediamine and/or oxybenzene sulphonate bleach activators; and (ii) from 0% to less than 40%, preferably to 15% or to 4%, or from 1% or from 2%, by weight of the composition, of a peroxide source, such as sodium percarbonate, sodium perborate monohydrate or sodium perborate tetrahydrate.

Preferred preformed peracid bleach systems comprise from 0-10%, most preferably 0.2-3% of one or more of the following (i) potassium peroxymonosulfate in the form of its triple salt $2KHSO_5.KHSO_4.K_2SO_4$ (Oxone®), (ii) ε-phthalimido peroxycaproic acid and (iii) magnesium monoperoxyphthalate.

Preferably diacyl peroxide bleach system comprise from 0-3%, most preferably 0-2% of dinonanoyl peroxide and from 0-0.02%, most preferably 0-0.001% pure enzyme lipase enzyme where the lipase is preferably Lipex®, a product of Novozymes, Bagsvaerd, Denmark. The compositions of the present invention may comprise further detergent ingredients as described below. Preferred are the chelants and especially hydroxyethane-dimethylene-phosphonic acid (HEDP), 2-phosphonobutane-1,2,4-tricarboxylic acid (PBTC) and/or 4,5-dihydroxy-m-benzenedisulfonic acid, disodium salt (Tiron®). Indeed it is believed that the combination of the endoglucanase and the bleach catalyst of the present invention with these chelants improves the cleaning performance of the bleach catalyst and endoglucanase on the fabric surface by assisting in soil removal, especially beverage, fruit and particulate soils, and (in the case of HEDP and PBTC) mitigating the formation of calcium carbonate crystals on the fibres which could otherwise interfere with the action of the bleach and endoglucanase. Another preferred ingredient is a fluorescent whitening agent, especially the following:

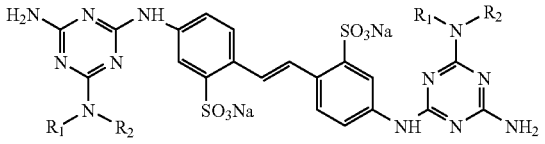

wherein R1 and R2, together with the nitrogen atom linking them, form an unsubstituted or C1-C4 alkyl-substituted morpholino, piperidine or pyrrolidine ring. Indeed it is believed that the combination of the endoglucanase and the bleach catalyst of the present invention with these fluorescent whitening agent enhanced fabric whitening by removing or bleaching soils that would otherwise interfere with the deposition or fluorescence of the fluorescent whitening agent.

The composition may be suitable for use as a laundry detergent composition, laundry additive composition, dishwashing composition, or hard surface cleaning composition. The composition is typically a detergent composition. The composition may be a fabric treatment composition. Preferably the composition is a laundry detergent composition.

The composition can be any form such as liquid or solid, although preferably the composition is in solid form. Typically, the composition is in particulate form such as an agglomerate, a spray-dried powder, an extrudate, a flake, a needle, a noodle, a bead, or any combination thereof. The composition may be in compacted particulate form, such as in the form of a tablet or bar. The composition may be in some other unit dose form, such as in the form of a pouch, wherein the composition is typically at least partically, preferably essentially completely, enclosed by a water-soluble film such as polyvinyl alcohol. Preferably, the composition is in free-flowing particulate form; by free-flowing particulate form, it is typically meant that the composition is in the form of separate discrete particles. The composition may be made by any suitable method including agglomeration, spray-drying, extrusion, mixing, dry-mixing, liquid spray-on, roller compaction, spheronisation, tabletting or any combination thereof.

The composition typically has a bulk density of from 350 g/l to 1,000 g/l, preferred low bulk density detergent compositions have a bulk density of from 550 g/l to 650 g/l and preferred high bulk density detergent compositions have a bulk density of from 750 g/l to 900 g/l. The composition may also have a bulk density of from 650 g/l to 750 g/l. During the laundering process, the composition is typically contacted with water to give a wash liquor having a pH of from above 7 to less than 13, preferably from above 7 to less than 10.5. This is the optimal pH to provide good cleaning whilst also ensuring a good fabric care profile.

Preferably, the composition comprises from 0% or from 1%, or from 2%, or from 3%, or from 4%, or from 5%, and to 30%, or to 20%, or to 10%, by weight of the composition, of a source of carbonate anion. The above described levels of a source of carbonate anion ensure that the composition has a good overall cleaning performance and a good bleaching performance.

The composition may comprise a dye transfer inhibitor. Suitable dye transfer inhibitors are selected from the group consisting of: polyvinylpyrrolidone, preferably having a weight average molecular weight of from 40,000 Da to 80,000 Da, preferably from 50,000 D1 to 70,000 Da; polyvinylimidazole, preferably having a weight average molecular weight of from 10,000 Da to 40,000 Da, preferably from 15,000 Da to 25,000 Da; polyvinyl pyridine N-oxide polymer, preferably having a weight average molecular weight of from 30,000 Da to 70,000 Da, preferably from 40,000 Da to 60,000 Da; a co-polymer of polyvinylpyrrolidone and vinyl imidazole, preferably having a weight average molecular weight of from 30,000 Da to 70,000 Da, preferably from 40,000 Da to 60,000 Da; and any combination thereof.

The composition may comprise from 0% to less than 5%, preferably to 4%, or to 3%, or to 2%, or even to 1%, by weight of the composition, of zeolite-builder. Whilst the composition may comprise zeolite-builder at a level of 5 wt % or greater, preferably the composition comprises less than 5 wt % zeolite-builder. It may be preferred for the composition to be essentially free of zeolite-builder. By: "essentially free of zeolite-builder", it is typically meant that the composition comprises no deliberately incorporated zeolite-builder. This is especially preferred when the composition is a solid laundry detergent composition and it is desirable for the composition to be very highly soluble, to minimize the amount of water-insoluble residues (for example, which may deposit on fabric surfaces), and also when it is highly desirable to have transparent wash liquor. Suitable zeolite-builders include zeolite A, zeolite X, zeolite P and zeolite MAP.

The composition may comprise from 0% to less than 40%, or less than 20%, preferably to 4%, or to 3%, or to 2%, or even to 1%, by weight of the composition, of phosphate-builder. Whilst the composition may comprise phosphate-builder at a level of 20 wt % or greater, preferably the composition comprises less than 20 wt % phosphate-builder. It may even be preferred for the composition to be essentially free of phosphate-builder. By: "essentially free of phosphate-builder", it is typically meant that the composition comprises no deliberately added phosphate-builder. This is especially preferred if it is desirable for the composition to have a very good environmental profile. Suitable phosphate-builders include sodium tripolyphosphate.

The composition may comprise from 0% to less than 20%, or preferably to 5%, or to 3%, or even to 2%, or to 1%, by weight of the composition, of silicate salt. Whilst the composition may comprise silicate salt at a level of 10 wt % or greater, preferably the composition comprises less than 5 wt % silicate salt. It may even be preferred for the composition to be essentially free of silicate salt. By: "essentially free from silicate salt", it is typically meant that the composition comprises no deliberately added silicate salt. This is especially preferred when the composition is a solid laundry detergent composition and it is desirable to ensure that the composition has very good dispensing and dissolution profiles and to ensure that the composition provides a clear wash liquor upon dissolution in water. The silicate salts include water-insoluble silicate salts. The silicate salts also include amorphous silicate salts and crystalline layered silicate salts (e.g. SKS-6). The silicate salts include sodium silicate.

The composition typically comprises adjunct ingredients. These adjunct ingredients include: detersive surfactants such as anionic detersive surfactants, non-ionic detersive surfactants, cationic detersive surfactants, zwitterionic detersive surfactants, amphoteric detersive surfactants; preferred anionic detersive surfactants are alkoxylated anionic detersive surfactants such as linear or branched, substituted or unsubstituted $C_{12-18}$ alkyl alkoxylated sulphates having an average degree of alkoxylation of from 1 to 30, preferably from 1 to 10, more preferably a linear or branched, substituted or unsubstituted $C_{12-18}$ alkyl ethoxylated sulphates having an average degree of ethoxylation of from 1 to 10, most preferably a linear unsubstituted $C_{12-18}$ alkyl ethoxylated sulphates having an average degree of ethoxylation of from 3 to 7, other preferred anionic detersive surfactants are alkyl sulphates, alkyl sulphonates, alkyl phosphates, alkyl phosphonates, alkyl carboxylates or any mixture thereof, preferred alkyl sulphates include linear or branched, substituted or unsubstituted $C_{10-18}$ alkyl sulphates, another preferred anionic detersive surfactant is a $C_{10-13}$ linear alkyl benzene sulphonate; preferred non-ionic detersive surfactants are $C_{8-18}$ alkyl alkoxylated alcohols having an average degree of alkoxylation of from 1 to 20, preferably from 3 to 10, most preferred are $C_{12-18}$ alkyl ethoxylated alcohols having an average degree of alkoxylation of from 3 to 10; preferred cationic detersive surfactants are mono-$C_{6-18}$ alkyl mono-hydroxyethyl di-methyl quaternary ammonium chlorides, more preferred are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride; source of peroxygen such as percarbonate salts and/or perborate salts, preferred is sodium percarbonate, the source of peroxygen is preferably at least partially coated, preferably completely coated, by a coating ingredient such as a carbonate salt, a sulphate salt, a silicate salt, borosilicate, or mixtures, including mixed salts thereof; bleach activators such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide; enzymes such as amylases, arabinases, xylanases, galactanases, glucanases, carbohydrases, other cellulases, laccases, oxidases, peroxidases, proteases, pectate lyases and mannanases, especially preferred are proteases; suds suppressing systems such as silicone based suds suppressors; fluorescent whitening agents; photobleach; filler salts such as sulphate salts, preferably sodium sulphate; fabric-softening agents such as clay, silicone and/or quaternary ammonium compounds, especially preferred is montmorillonite clay optionally in combination with a silicone; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as hydrophobically modified cellulose and oligomers produced by the condensation of imidazole and epichlorhydrin; soil dispersants and soil anti-redeposition aids such as alkoxylated polyamines and ethoxylated ethyleneimine polymers; anti-redeposition components such as carboxymethyl cellulose and polyesters; perfumes; sulphamic acid or salts thereof; citric acid or salts thereof; carbonate salts, especially preferred is sodium carbonate; and dyes such as orange dye, blue dye, green dye, purple dye, pink dye, or any mixture thereof.

The Endoglucanase

The composition comprises one or more bacterial alkaline enzyme(s) exhibiting endo-beta-1,4-glucanase activity (E.C. 3.2.1.4). The combination of the endoglucanase with the bleach catalyst significantly improves the cleaning and whitening performance while retaining good stability of the enzyme during storage and during the wash process.

As used herein the term "alkaline endoglucanase", shall mean an endoglucanase having an pH optimum above 7 and retaining greater than 70% of its optimal activity at pH 10. The endoglucanase will typically be comprised in the detergent composition at a level of from 0.00005% to 0.15%, from 0.0002% to 0.02%, or even from 0.0005% to 0.01% by weight of pure enzyme.

Preferably, the endoglucanase is a bacterial polypeptide endogenous to a member of the genus *Bacillus*.

More preferably, the alkaline enzyme exhibiting endo-beta-1,4-glucanase activity (E.C. 3.2.1.4), is a polypeptide containing (i) at least one family 17 carbohydrate binding module (Family 17 CBM) and/or (ii) at least one family 28 carbohydrate binding module (Family 28 CBM). Please refer for example to: Current Opinion in Structural Biology, 2001, 593-600 by Y. Bourne and B. Henrissat in their article entitled: "Glycoside hydrolases and glycosyltransferases: families and functional modules" for the definition and classification of CBMs. Please refer further to Biochemical Journal, 2002, v361, 35-40 by A. B. Boraston et al in their article entitled: "Identification and glucan-binding properties of a new carbohydrate-binding module family" for the properties of the family 17 and 28 CBM's.

In a more preferred embodiment, said enzyme comprises a polypeptide (or variant thereof) endogenous to one of the following *Bacillus* species:

| *Bacillus* sp. | As described in: |
|---|---|
| AA349 (DSM 12648) | WO 2002/099091A (Novozymes) p2, line 25<br>WO 2004/053039A (Novozymes) p3, line19 |
| KSM S237 | EP 1350843A (Kao) p3, line 18 |
| 1139 | EP 1350843A (Kao) p3, line 22 |
| KSM 64 | EP 1350843A (Kao) p3, line 24 |
| KSM N131 | EP 1350843A (Kao) p3, line 25 |
| KSM 635, FERM BP 1485 | EP 265 832A (Kao) p7, line 45 |
| KSM 534, FERM BP 1508 | EP 0271044 A (Kao) p9, line 21 |
| KSM 539, FERM BP 1509 | EP 0271044 A (Kao) p9, line 22 |
| KSM 577, FERM BP 1510 | EP 0271044 A (Kao) p9, line 22 |
| KSM 521, FERM BP 1507 | EP 0271044 A (Kao) p9, line 19 |
| KSM 580, FERM BP 1511 | EP 0271044 A (Kao) p9, line 20 |
| KSM 588, FERM BP 1513 | EP 0271044 A (Kao) p9, line 23 |
| KSM 597, FERM BP 1514 | EP 0271044 A (Kao) p9, line 24 |
| KSM 522, FERM BP 1512 | EP 0271044 A (Kao) p9, line 20 |
| KSM 3445, FERM BP 1506 | EP 0271044 A (Kao) p10, line 3 |
| KSM 425. FERM BP 1505 | EP 0271044 A (Kao) p10, line 3 |

Suitable endoglucanases for the compositions of the present invention are:

1) An enzyme exhibiting endo-beta-1,4-glucanase activity (E.C. 3.2.1.4), which has a sequence of at least 90%, preferably 94%, more preferably 97% and even more preferably 99%, 100% identity to the amino acid sequence of position 1 to position 773 of SEQ ID NO:1 (Corresponding to SEQ ID NO:2 in WO02/099091); or a fragment thereof that has endo-beta-1,4-glucanase activity, when identity is determined by GAP provided in the GCG program using a GAP creation penalty of 3.0 and GAP extension penalty of 0.1. The enzyme and the corresponding method of production is described extensively in patent application WO02/099091 published by Novozymes A/S on Dec. 12, 2002. Please refer to the detailed description pages 4 to 17 and to the examples page 20 to page 26. One of such enzyme is commercially available under the tradename Celluclean™ by Novozymes A/S.

GCG refers to the sequence analysis software package provided by Accelrys, San Diego, Calif., USA. This incorporates a program called GAP which uses the algorithm of Needleman and Wunsch to find the alignment of two complete sequences that maximises the number of matches and minimises the number of gaps.

2) Also suitable are the alkaline endoglucanase enzymes described in EP 1 350 843A published by Kao corporation on Oct. 8, 2003. Please refer to the detailed description [0011] to [0039] and examples 1 to 4 [0067] to [0077] for a detailed description of the enzymes and its production. The alkaline cellulase variants are obtained by substituting the amino acid residue of a cellulase having an amino acid sequence exhibiting at least 90%, preferably 95%, more preferably 98% and even 100% identity with the amino acid sequence represented by SEQ. ID NO:2 (Corresponding to SEQ. ID NO:1 in EP 1 350 843 on pages 11-13) at (a) position 10, (b) position 16, (c) position 22, (d) position 33, (e) position 39, (f) position 76, (g) position 109, (h) position 242, (i) position 263, (j) position 308, (k) position 462, (l) position 466, (m) position 468, (n) position 552, (o) position 564, or (p) position 608 in SEQ ID NO:2 or at a position corresponding thereto with another amino acid residue Examples of the "alkaline cellulase having the amino acid sequence represented by SEQ. ID NO:2" include Eg1-237 [derived from *Bacillus* sp. strain KSM-S237 (FERM BP-7875), Hakamada, et al., Biosci. Biotechnol. Biochem., 64, 2281-2289, 2000]. Examples of the "alkaline cellulase having an amino acid sequence exhibiting at least 90% homology with the amino acid sequence represented by SEQ. ID NO:2" include alkaline cellulases having an amino acid sequence exhibiting preferably at least 95% homology, more preferably at least 98% homology, with the amino acid sequence represented by SEQ. ID NO:2. Specific examples include alkaline cellulase derived from *Bacillus* sp. strain 1139 (Eg1-1139) (Fukumori, et al., J. Gen. Microbiol., 132, 2329-2335) (91.4% homology), alkaline cellulases derived from *Bacillus* sp. strain KSM-64 (Eg1-64) (Sumitomo, et al., Biosci. Biotechnol. Biochem., 56, 872-877, 1992) (homology: 91.9%), and cellulase derived from *Bacillus* sp. strain KSM-N131 (Eg1-N131b) (Japanese Patent Application No. 2000-47237) (homology: 95.0%).

The amino acid is preferably substituted by: glutamine, alanine, proline or methionine, especially glutamine is preferred at position (a), asparagine or arginine, especially asparagine is preferred at position (b), proline is preferred at position (c), histidine is preferred at position (d), alanine, threonine or tyrosine, especially alanine is preferred at position (e), histidine, methionine, valine, threonine or alanine, especially histidine is preferred at position (f), isoleucine, leucine, serine or valine, especially isoleucine is preferred at position (g), alanine, phenylalanine, valine, serine, aspartic acid, glutamic acid, leucine, isoleucine, tyrosine, threonine, methionine or glycine, especially alanine, phenylalanine or serine is preferred at position (h), isoleucine, leucine, proline or valine, especially isoleucine is preferred at position (i), alanine, serine, glycine or valine, especially alanine is preferred at position (j), threonine, leucine, phenylalanine or arginine, especially threonine is preferred at position (k), leucine, alanine or serine, especially leucine is preferred at position (l), alanine, aspartic acid, glycine or lysine, especially alanine is preferred at position (m), methionine is preferred at position (n), valine, threonine or leucine, especially valine is preferred at position (o) and isoleucine or arginine, especially isoleucine is preferred at position (p).

The "amino acid residue at a position corresponding thereto" can be identified by comparing amino acid sequences by using known algorithm, for example, that of Lipman-Pearson's method, and giving a maximum similarity score to the multiple regions of simirality in the amino acid sequence of each alkaline cellulase. The position of the homologous amino acid residue in the sequence of each cellulase can be determined, irrespective of insertion or depletion existing in the amino acid sequence, by aligning the amino acid sequence of the cellulase in such manner (FIG. 1 of EP 1 350 843). It is presumed that the homologous position exists at the three-dimensionally same position and it brings about similar effects with regard to a specific function of the target cellulase.

With regard to another alkaline cellulase having an amino acid sequence exhibiting at least 90% homology with SEQ. ID NO:2, specific examples of the positions corresponding to (a) position 10, (b), position 16, (c) position 22, (d) position 33, (e) position 39, (f) position 76, (g) position 109, (h) position 242, (i) position 263, (j) position 308, (k) position 462, (l) position 466, (m) position 468, (n) position 552, (o) position 564 and (p) position 608 of the alkaline cellulase (Eg1-237) represented by SEQ. ID NO: 2 and amino acid residues at these positions will be shown below:

| | Egl-237 | Egl-1139 | Egl-64 | Egl-N131b |
|---|---|---|---|---|
| (a) | 10Leu | 10Leu | 10Leu | 10Leu |
| (b) | 16Ile | 16Ile | 16Ile | Nothing corresponding thereto |
| (c) | 22Ser | 22Ser | 22Ser | Nothing corresponding thereto |
| (d) | 33Asn | 33Asn | 33Asn | 19Asn |
| (e) | 39Phe | 39Phe | 39Phe | 25Phe |
| (f) | 76Ile | 76Ile | 76Ile | 62Ile |
| (g) | 109Met | 109Met | 109Met | 95Met |
| (h) | 242Gln | 242Gln | 242Gln | 228Gln |
| (i) | 263Phe | 263Phe | 263Phe | 249Phe |
| (j) | 308Thr | 308Thr | 308Thr | 294Thr |
| (k) | 462Asn | 461Asn | 461Asn | 448Asn |
| (l) | 466Lys | 465Lys | 465Lys | 452Lys |
| (m) | 468Val | 467Val | 467Val | 454Val |
| (n) | 552Ile | 550Ile | 550Ile | 538Ile |
| (o) | 564Ile | 562Ile | 562Ile | 550Ile |
| (p) | 608Ser | 606Ser | 606Ser | 594Ser |

3) Also suitable is the alkaline cellulase K described in EP 265 832A published by Kao on May 4, 1988. Please refer to the description page 4, line 35 to page 12, line 22 and examples 1 and 2 on page 19 for a detailed description of the enzyme and its production. The alkaline cellulase K has the following physical and chemical properties:

(1) Activity: Having a Cx enzymatic activity of acting on carboxymethyl cellulose along with a weak $C_1$ enzymatic activity and a weak beta-glucoxidase activity;

(2) Specificity on Substrates: Acting on carboxymethyl cellulose (CMC), crystalline cellulose, Avicell, cellobiose, and p-nitrophenyl cellobioside (PNPC);

(3) Having a working pH in the range of 4 to 12 and an optimum pH in the range of 9 to 10;

(4) Having stable pH values of 4.5 to 10.5 and 6.8 to 10 when allowed to stand at 40° C. for 10 minutes and 30 minutes, respectively;

(5) Working in a wide temperature range of from 10 to 65° C. with an optimum temperature being recognized at about 40° C.;

(6) Influences of chelating agents: The activity not impeded with ethylenediamine tetraacetic acid (EDTA), ethyleneglycol-bis-(β-aminoethylether) N,N,N',N"-tetraacetic acid (EGTA), N,N-bis(carboxymethyl)glycine (nitrilotriacetic acid) (NTA), sodium tripolyphosphate (STPP) and zeolite;

(7) Influences of surface active agents: Undergoing little inhibition of activity by means of surface active agents such as sodium linear alkylbenzenesulfonates (LAS), sodium alkylsulfates (AS), sodium polyoxyethylene alkylsulfates (ES), sodium alpha-olefinsulfonates (AOS), sodium alpha-sulfonated aliphatic acid esters (alpha-SFE), sodium alkylsulfonates (SAS), polyoxyethylene secondary alkyl ethers, fatty acid salts (sodium salts), and dimethyldialkylammonium chloride;

(8) Having a strong resistance to proteinases; and (9) Molecular weight (determined by gel chromatography): Having a maximum peak at 180,000±10,000.

Preferably such enzyme is obtained by isolation from a culture product of *Bacillus* sp KSM-635.

Cellulase K is commercially available by the Kao Corporation: e.g. the cellulase preparation Eg-X known as KAC® being a mixture of E-H and E-L both from *Bacillus* sp. KSM-635 bacterium. Cellulases E-H and E-L have been described in S. Ito, Extremophiles, 1997, v 1, 61-66 and in S. Ito et al, Agric Biol Chem, 1989, v53, 1275-1278.

4) The alkaline bacterial endoglucanases described in EP 271 004A published by Kao on Jun. 15, 1988 are also suitable for the purpose of the present invention. Please refer to the description page 9, line 15 to page 23, line 17 and page 31, line 1 to page 33, line 17 for a detailed description of the enzymes and its production. Those are:

Alkaline Cellulase K-534 from KSM 534, FERM BP 1508,
Alkaline Cellulase K-539 from KSM 539, FERM BP 1509,
Alkaline Cellulase K-577 from KSM 577, FERM BP 1510,
Alkaline Cellulase K-521 from KSM 521, FERM BP 1507,
Alkaline Cellulase K-580 from KSM 580, FERM BP 1511,
Alkaline Cellulase K-588 from KSM 588, FERM BP 1513,
Alkaline Cellulase K-597 from KSM 597, FERM BP 1514,
Alkaline Cellulase K-522 from KSM 522, FERM BP 1512,
Alkaline Cellulase E-II from KSM 522, FERM BP 1512,
Alkaline Cellulase E-III from KSM 522, FERM BP 1512.
Alkaline Cellulase K-344 from KSM 344, FERM BP 1506, and
Alkaline Cellulase K-425 from KSM 425, FERM BP 1505.

5) Finally, the alkaline endoglucanases derived from *Bacillus* species KSM-N described in JP2005287441A, published by Kao on the Oct. 20, 2005, are also suitable for the purpose of the present invention. Please refer to the description page 4, line 39 to page 10, line 14 for a detailed description of the enzymes and its production. Examples of such alkaline endoglucanases are:

Alkaline Cellulase Eg1-546H from *Bacillus* sp. KSM-N546
Alkaline Cellulase Eg1-115 from *Bacillus* sp. KSM-N115
Alkaline Cellulase Eg1-145 from *Bacillus* sp. KSM-N145
Alkaline Cellulase Eg1-659 from *Bacillus* sp.KSM-N659
Alkaline Cellulase Eg1-640 from *Bacillus* sp.KSM-N440

Also encompassed in the present invention are variants of the above described enzymes obtained by various techniques known by persons skilled in the art such as directed evolution.

Bleach Catalyst

The bleach catalyst is capable of accepting an oxygen atom from a peroxyacid and/or salt thereof, and transferring the oxygen atom to an oxidizeable substrate. Suitable bleach catalysts include, but are not limited to: iminium cations and polyions; iminium zwitterions; modified amines; modified amine oxides; N-sulphonyl imines; N-phosphonyl imines; N-acyl imines; thiadiazole dioxides; perfluoroimines; cyclic sugar ketones and mixtures thereof.

The bleach catalyst will typically be comprised in the detergent composition at a level of from 0.0005% to 0.2%, from 0.001% to 0.1%, or even from 0.005% to 0.05% by weight.

Suitable iminium cations and polyions include, but are not limited to, N-methyl-3,4-dihydroisoquinolinium tetrafluoroborate, prepared as described in Tetrahedron (1992), 49(2), 423-38 (see, for example, compound 4, p. 433); N-methyl-3,4-dihydroisoquinolinium p-toluene sulphonate, prepared as described in U.S. Pat. No. 5,360,569 (see, for example, Column 11, Example 1); and N-octyl-3,4-dihydroisoquinolinium p-toluene sulphonate, prepared as described in U.S. Pat. No. 5,360,568 (see, for example, Column 10, Example 3).

Suitable iminium zwitterions include, but are not limited to, N-(3-sulfopropyl)-3,4-dihydroisoquinolinium, inner salt, prepared as described in U.S. Pat. No. 5,576,282 (see, for example, Column 31, Example II); N-[2-(sulphooxy)dodecyl]-3,4-dihydroisoquinolinium, inner salt, prepared as described in U.S. Pat. No. 5,817,614 (see, for example, Column 32, Example V); 2-[3-[(2-ethylhexyl)oxy]-2-(sulphooxy)propyl]-3,4-dihydroisoquinolinium, inner salt, prepared as described in WO05/047264 (see, for example, page 18, Example 8), and 2-[3-[(2-butyloctyl)oxy]-2-(sulphooxy)propyl]-3,4-dihydroisoquinolinium, inner salt.

Suitable modified amine oxygen transfer catalysts include, but are not limited to, 1,2,3,4-tetrahydro-2-methyl-1-isoquinolinol, which can be made according to the procedures described in Tetrahedron Letters (1987), 28(48), 6061-6064. Suitable modified amine oxide oxygen transfer catalysts include, but are not limited to, sodium 1-hydroxy-N-oxy-N-[2-(sulphooxy)decyl]-1,2,3,4-tetrahydroisoquinoline.

Suitable N-sulphonyl imine oxygen transfer catalysts include, but are not limited to, 3-methyl-1,2-benzisothiazole 1,1-dioxide, prepared according to the procedure described in the Journal of Organic Chemistry (1990), 55(4), 1254-61.

Suitable N-phosphonyl imine oxygen transfer catalysts include, but are not limited to, [R-(E)]-N-[(2-chloro-5-nitrophenyl)methylene]-P-phenyl-P-(2,4,6-trimethylphenyl)-phosphinic amide, which can be made according to the procedures described in the Journal of the Chemical Society, Chemical Communications (1994), (22), 2569-70.

Suitable N-acyl imine oxygen transfer catalysts include, but are not limited to, [N(E)]-N-(phenylmethylene)acetamide, which can be made according to the procedures described in Polish Journal of Chemistry (2003), 77(5), 577-590.

Suitable thiadiazole dioxide oxygen transfer catalysts include but are not limited to, 3-methyl-4-phenyl-1,2,5-thiadiazole 1,1-dioxide, which can be made according to the procedures described in U.S. Pat. No. 5,753,599 (Column 9, Example 2).

Suitable perfluoroimine oxygen transfer catalysts include, but are not limited to, (Z)-2,2,3,3,4,4,4-heptafluoro-N-(nonafluorobutyl)butanimidoyl fluoride, which can be made according to the procedures described in Tetrahedron Letters (1994), 35(34), 6329-30.

Suitable cyclic sugar ketone oxygen transfer catalysts include, but are not limited to, 1,2:4,5-di-O-isopropylidene-D-erythro-2,3-hexodiuro-2,6-pyranose as prepared in U.S. Pat. No. 6,649,085 (Column 12, Example 1).

Preferably, the bleach catalyst comprises an iminium and/or carbonyl functional group and is typically capable of forming an oxaziridinium and/or dioxirane functional group upon acceptance of an oxygen atom, especially upon acceptance of an oxygen atom from a peroxyacid and/or salt thereof. Preferably, the bleach catalyst comprises an oxaziridinium functional group and/or is capable of forming an oxaziridinium functional group upon acceptance of an oxygen atom, especially upon acceptance of an oxygen atom from a peroxyacid and/or salt thereof. Preferably, the bleach catalyst comprises a cyclic iminium functional group, preferably wherein the cyclic moiety has a ring size of from five to eight atoms (including the nitrogen atom), preferably six atoms. Preferably, the bleach catalyst comprises an aryliminium functional group, preferably a bi-cyclic aryliminium functional group, preferably a 3,4-dihydroisoquinolinium functional group. Typically, the imine functional group is a quaternary imine functional group and is typically capable of forming a quaternary oxaziridinium functional group upon acceptance of an oxygen atom, especially upon acceptance of an oxygen atom from a peroxyacid and/or salt thereof.

Preferably, the bleach catalyst has a chemical structure corresponding to the following chemical formula

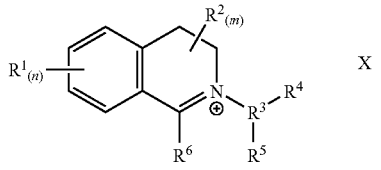

wherein: n and m are independently from 0 to 4, preferably n and m are both 0; each $R^1$ is independently selected from a substituted or unsubstituted radical selected from the group consisting of hydrogen, alkyl, cycloalkyl, aryl, fused aryl, heterocyclic ring, fused heterocyclic ring, nitro, halo, cyano, sulphonato, alkoxy, keto, carboxylic, and carboalkoxy radicals; and any two vicinal $R^1$ substituents may combine to form a fused aryl, fused carbocyclic or fused heterocyclic ring; each $R^2$ is independently selected from a substituted or unsubstituted radical independently selected from the group consisting of hydrogen, hydroxy, alkyl, cycloalkyl, alkaryl, aryl, aralkyl, alkylenes, heterocyclic ring, alkoxys, arylcarbonyl groups, carboxyalkyl groups and amide groups; any $R^2$ may be joined together with any other of $R^2$ to form part of a common ring; any geminal $R^2$ may combine to form a carbonyl; and any two $R^2$ may combine to form a substituted or unsubstituted fused unsaturated moiety; $R^3$ is a $C_1$ to $C_{20}$ substituted or unsubstituted alkyl; $R^4$ is hydrogen or the moiety $Q_t$-A, wherein: Q is a branched or unbranched alkylene, t=0 or 1 and A is an anionic group selected from the group consisting of $OSO_3^-$, $SO_3^-$, $CO_2^-$, $OCO_2^-$, $OPO_3^{2-}$, $OPO_3H^-$ and $OPO_2^-$; $R^5$ is hydrogen or the moiety —$CR^{11}R^{12}$—Y-$G_b$-$Y_c$-$[(CR^9R^{10})_y$—$O]_k$—$R^8$, wherein: each Y is independently selected from the group consisting of O, S, N—H, or N—$R^8$; and each $R^8$ is independently selected from the group consisting of alkyl, aryl and heteroaryl, said moieties being substituted or unsubstituted, and whether substituted or unsubstituted said moieties having less than 21 carbons; each G is independently selected from the group consisting of CO, $SO_2$, SO, PO and $PO_2$; $R^9$ and $R^{10}$ are independently selected from the group consisting of H and $C_1$-$C_4$ alkyl; $R^{11}$ and $R^{12}$ are independently selected from the group consisting of H and alkyl, or when taken together may join to form a carbonyl; b=0 or 1; c can=0 or 1, but c must =0 if b=0; y is an integer from 1 to 6; k is an integer from 0 to 20; $R^6$ is H, or an alkyl, aryl or heteroaryl moiety; said moieties being substituted or unsubstituted; and X, if present, is a suitable charge balancing counterion, preferably X is present when $R^4$ is hydrogen, suitable X, include but are not limited to: chloride, bromide, sulphate, methosulphate, sulphonate, p-toluenesulphonate, borontetraflouride and phosphate.

In one embodiment of the present invention, the bleach catalyst has a structure corresponding to general formula below:

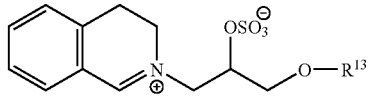

wherein $R^{13}$ is a branched alkyl group containing from three to 24 carbon atoms (including the branching carbon atoms) or a linear alkyl group containing from one to 24 carbon atoms; preferably $R^{13}$ is a branched alkyl group containing from eight to 18 carbon atoms or linear alkyl group containing from eight to eighteen carbon atoms; preferably $R^{13}$ is selected from the group consisting of 2-propylheptyl, 2-butyloctyl, 2-pentylnonyl, 2-hexyldecyl, n-dodecyl, n-tetradecyl, n-hexadecyl, n-octadecyl, iso-nonyl, iso-decyl, iso-tridecyl and iso-pentadecyl; preferably $R^{13}$ is selected from the group consisting of 2-butyloctyl, 2-pentylnonyl, 2-hexyldecyl, iso-tridecyl and iso-pentadecyl.

Oxybenzene Sulphonate and/or Oxybenzoic Bleach Activators

In another embodiment, the composition can further comprises (i) oxybenzene sulphonate bleach activators and/or oxybenzoic bleach activators and (ii) a source of peroxygen. Typically, the oxybenzoic acid bleach activator is in its salt form. Preferred oxybenzene sulphonate bleach activators include bleach activators having the general formula:

R—(C=O)-L wherein R is an alkyl group, optionally branched, having, when the bleach activator is hydrophobic, from 6 to 14 carbon atoms, or from 8 to 12 carbon atoms and L is leaving group. Examples of suitable leaving groups are benzoic acid and derivatives thereof, especially salts thereof. Another especially preferred leaving group is oxybenzene sulphonate. Suitable bleach activators include dodecanoyl oxybenzene sulphonate, decanoyl oxybenzene sulphonate, a salt of decanoyl oxybenzoic acid, 3,5,5-trimethyl hexanoyloxybenzene sulphonate, nonanoylamidocaproyloxybenzene sulphonate, and nonanoyloxybenzene sulphonate (NOBS). Suitable bleach activators are also disclosed in WO 98/17767. The incorporation of these bleach activators into the composition is especially preferred when the composition comprises low levels of zeolite builder and phosphate builder.

Diacyl Peroxide

In another embodiment the composition further comprises: (i) a lipase; and (ii) a diacyl and/or tetraacyl peroxide species so as to generate peracid during the wash process. The diacyl peroxide bleaching species is preferably selected from diacyl peroxides of the general formula:

$R^1$—C(O)—OO—(O)C—$R^2$ in which $R^1$ represents a $C_6$-$C_{18}$ alkyl, preferably $C_6$-$C_{12}$ alkyl group containing a linear chain of at least 5 carbon atoms and optionally containing one or more substituents (e.g. —$N^+(CH_3)_3$, —COOH or —CN) and/or one or more interrupting moieties (e.g. —CONH— or —CH=CH—)

interpolated between adjacent carbon atoms of the alkyl radical, and $R^2$ represents an aliphatic group compatible with a peroxide moiety, such that $R^1$ and $R^2$ together contain a total of 8 to 30 carbon atoms. In one preferred aspect $R^1$ and $R^2$ are linear unsubstituted $C_6$-$C_{12}$ alkyl chains. Most preferably $R^1$ and $R^2$ are identical. Diacyl peroxides, in which both $R^1$ and $R^2$ are $C_6$-$C_{12}$ alkyl groups, are particularly preferred. Preferably, at least one of, most preferably only one of, the R groups ($R_1$ or $R_2$), does not contain branching or pendant rings in the alpha position, or preferably neither in the alpha nor beta positions or most preferably in none of the alpha or beta or gamma positions. In one further preferred embodiment the DAP may be asymmetric, such that preferably the hydrolysis of R1 acyl group is rapid to generate peracid, but the hydrolysis of R2 acyl group is slow.

The tetraacyl peroxide bleaching species is preferably selected from tetraacyl peroxides of the general formula:

$$R^3—C(O)—OO—C(O)—(CH_2)n—C(O)—OO—C(O)—R^3$$

in which $R^3$ represents a $C_1$-$C_9$ alkyl, preferably $C_3$-$C_7$, group and n represents an integer from 2 to 12, preferably 4 to 10 inclusive.

Preferably, the diacyl and/or tetraacyl peroxide bleaching species is present in an amount sufficient to provide at least 0.5 ppm, more preferably at least 10 ppm, and even more preferably at least 50 ppm by weight of the wash liquor. In a preferred embodiment, the bleaching species is present in an amount sufficient to provide from about 0.5 to about 300 ppm, more preferably from about 30 to about 150 ppm by weight of the wash liquor.

Pre-formed Peroxyacid

The pre-formed peroxyacid or salt thereof is typically either a peroxycarboxylic acid or salt thereof, or a peroxysulphonic acid or salt thereof.

The pre-formed peroxyacid or salt thereof is preferably a peroxycarboxylic acid or salt thereof, typically having a chemical structure corresponding to the following chemical formula:

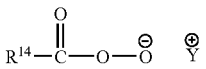

wherein: $R^{14}$ is selected from alkyl, aralkyl, cycloalkyl, aryl or heterocyclic groups; the $R^{14}$ group can be linear or branched, substituted or unsubstituted; and Y is any suitable counter-ion that achieves electric charge neutrality, preferably Y is selected from hydrogen, sodium or potassium. Preferably, $R^{14}$ is a linear or branched, substituted or unsubstituted $C_{6-9}$ alkyl. Preferably, the peroxyacid or salt thereof is selected from peroxyhexanoic acid, peroxyheptanoic acid, peroxyoctanoic acid, peroxynonanoic acid, peroxydecanoic acid, any salt thereof, or any combination thereof. Preferably, the peroxyacid or salt thereof has a melting point in the range of from 30° C. to 60° C.

The pre-formed peroxyacid or salt thereof can also be a peroxysulphonic acid or salt thereof, typically having a chemical structure corresponding to the following chemical formula:

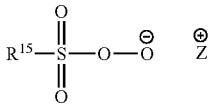

wherein: $R^{15}$ is selected from alkyl, aralkyl, cycloalkyl, aryl or heterocyclic groups; the $R^{15}$ group can be linear or branched, substituted or unsubstituted; and Z is any suitable counter-ion that achieves electric charge neutrality, preferably Z is selected from hydrogen, sodium or potassium. Preferably $R^{15}$ is a linear or branched, substituted or unsubstituted $C_{6-9}$ alkyl.

Preferred preformed peracid bleach systems comprise from 0-10%, most preferably 0.2-3% of one or more of the following (i) potassium peroxymonosulfate in the form of its triple salt $2KHSO_5.KHSO_4.K_2SO_4$ (Oxone®), (ii) ϵ-phthalimido peroxycaproic acid and (iii) magnesium monoperoxyphthalate.

EXAMPLES

Example 1

Preparation of Sulphuric acid mono-[2-(3,4-dihydro-isoquinolin-2-yl)-1-(2-ethylhexyloxymethyl)-ethyl] ester, internal salt Preparation of 2-ethylhexyl glycidyl ether: To a flame dried, 500 mL round bottomed flask equipped with an addition funnel charged with epichlorohydrin (15.62 g, 0.17 moles), is added 2-ethylhexanol (16.5 g, 0.127 moles) and stannic chloride (0.20 g, 0.001 moles). The reaction is kept under an argon atmosphere and warmed to 90° C. using an oil bath. Epichlorohydrin is dripped into the stirring solution over 60 minutes followed by stirring at 90° C. for 18 hours. The reaction is fitted with a vacuum distillation head and 1-chloro-3-(2-ethyl-hexyloxy)-propan-2-ol is distilled under 0.2 mm Hg. The 1-chloro-3-(2-ethyl-hexyloxy)-propan-2-ol (4.46 g, 0.020 moles) is dissolved in tetrahydrofuran (50 mL) and stirred at room temperature under an argon atmosphere. To the stirring solution is added potassium tert-butoxide (2.52 g, 0.022 moles) and the suspension is stirred at room temperature for 18 hours. The reaction is then evaporated to dryness, residue dissolved in hexanes and washed with water (100 mL). The hexanes phase is separated, dried with $Na_2SO_4$, filtered and evaporated to dryness to yield the crude 2-ethylhexyl glycidyl ether, which can be further purified by vacuum distillation.

Preparation of Sulphuric acid mono-[2-(3,4-dihydro-isoquinolin-2-yl)-1-(2-ethylhexyloxymethyl)-ethyl]ester, internal salt: To a flame dried 250 mL three neck round bottomed flask, equipped with a condenser, dry argon inlet, magnetic stir bar, thermometer, and heating bath is added 3,4-dihydroisoquinoline (0.40 mol.; prepared as described in Example I of U.S. Pat. No. 5,576,282), 2-ethylhexyl glycidyl ether (0.38 mol, prepared as described above), $SO_3$-DMF complex (0.38 mol), and acetonitrile (500 mL). The reaction is warmed to 80° C. and stirred at temperature for 72 hours. The reaction is cooled to room temperature, evaporated to dryness and the residue recrystallized from ethyl acetate and/or ethanol to yield the desired product. The solvent acetonitrile may be replaced with other solvents, including but not limited to, 1,2-dichloroethane.

Example 2

Preparation of Sulphuric acid mono-[2-(3,4-dihydro-isoquinolin-2-yl)-1-(2-butyl-octyloxymethyl)-ethyl] ester, internal salt The desired product is prepared according to Example 1 but substituting 2-butyloctanol for 2-hexyloctanol.

Example 3

Laundry Detergent Compositions

The following laundry detergent compositions A, B, C and D are suitable for use in the present invention. They are suitable for use with front loading automatic washing machines

| Ingredient | A wt % | B wt % | C wt % | D wt % |
|---|---|---|---|---|
| Bleach catalyst made according to example 1 or 2 | 0.1 | 0.05 | 0.03 | 0.05 |
| Endoglucanase† (15.6 mg/g active) | 0.2 | 0.1 | 0.3 | 0.05 |
| Savinase* 32.89 mg/g | 0.1 | 0.2 | 0.3 | 0.16 |
| Natalase* 8.65 mg/g | 0.2 | — | 0.1 | 0.16 |
| Lipex* 18 mg/g | 0.1 | — | — | — |
| Sodium linear $C_{12-13}$ alkyl benzenesulphonate (LAS) | 9.0 | 8 | 7.5 | 7.0 |
| Tallow alkyl sulphate (TAS) | 1.0 | 1.0 | — | — |
| $C_{14-15}$ alkyl ethoxylated alcohol having an average degree of ethoxylation of 7 (AE7) | 2.5 | — | — | — |
| $C_{14-15}$ alkyl ethoxylated alcohol sulphate having an average degree of ethoxylation of 3 ($AE_3S$) | — | 4.0 | 3.0 | 2.5 |
| Mono-$C_{12-14}$ alkyl mono-hydroxyethyl di-methyl quaternary ammonium chloride | 1.5 | 1.0 | — | — |
| Zeolite 4A | 15.0 | 12.5 | — | — |
| Citric Acid | 3.0 | 2.0 | 3.0 | 3.0 |
| Sodium Percarbonate | 20 | 15 | 17.5 | 14 |
| TAED (tetraacetylethylenediamine) | 2.5 | 3.0 | 2.3 | 1.6 |
| NOBS (nonanoyloxybenzene sulphonate) | — | 1.0 | — | 1.5 |
| Sodium carbonate | 20 | 25 | 20 | 25 |
| Polymeric carboxylate Sokalan ® CP5 ex BASF | 2.0 | 1.5 | 3.0 | 2.5 |
| A compound having the following general structure: bis(($C_2H_5O$)($C_2H_4O$)n)($CH_3$)—$N^+$—$C_xH_{2x}$—$N^+$—($CH_3$)-bis(($C_2H_5O$)($C_2H_4O$)n), wherein n = from 20 to 30, and x = from 3 to 8, or sulphated or sulphonated variants thereof | 1.0 | 0.5 | 0.75 | 1.0 |
| Carboxymethyl cellulose | — | — | 1.5 | 1.0 |
| Ethylene diamine disuccinic acid | 0.5 | 0.1 | 0.2 | 0.25 |
| Magnesium sulphate | 0.75 | 0.5 | 1.0 | 0.5 |
| Hydroxyethane di(methylene phosphonic acid) | 0.5 | 0.25 | 0.2 | 0.4 |
| Fluorescent whitening agent | 0.2 | 0.1 | 0.15 | 0.25 |
| Silicone suds suppressing agent | 0.1 | 0.05 | 0.1 | 0.1 |
| Soap | 0.5 | 0.25 | — | 0.3 |
| Photobleach | 0.01 | 0.0001 | 0.0005 | 0.0015 |
| Perfume | 1.0 | 0.5 | 0.75 | 0.5 |
| Sodium sulphate | 13 | 15 | 30 | 30 |
| Water and miscellaneous | to 100% | to 100% | to 100% | to 100% |

The following laundry detergent compositions E, F, G and H are suitable for use in the present invention. They are also suitable for use with front-loading washing machines

| Ingredient | E wt % | F wt % | G wt % | H wt % |
|---|---|---|---|---|
| Bleach catalyst made according to example 1 or 2 | 0.0074 | 0.02 | 0.01 | 0.05 |
| Diacyl peroxide*** | 2 | 1 | 0.5 | 1 |
| Endoglucanase† (15.6 mg/g active) | 0.2 | 0.1 | 0.3 | 0.05 |
| Savinase* 32.89 mg/g | 0.1 | 0.2 | 0.3 | 0.5 |
| Natalase* 8.65 mg/g | 0.2 | — | 0.1 | — |
| Lipex* 9 mg/g | 0.5 | 0.3 | — | 0.1 |
| Sodium linear $C_{12-13}$ alkyl benzenesulphonate (LAS) | 8.0 | 5.0 | 7.5 | 7.0 |
| $C_{14-15}$ alkyl ethoxylated alcohol sulphate having an average degree of ethoxylation of 3 ($AE_3S$) | 5.0 | 2.5 | 3.5 | 6.0 |
| Citric Acid | 3.0 | 2.0 | 5.0 | 2.5 |
| Sodium carbonate | 20 | 25 | 22.5 | 25 |
| Polymeric carboxylate | 2.0 | 3.5 | 3.5 | 2.5 |

-continued

| Ingredient | E wt % | F wt % | G wt % | H wt % |
|---|---|---|---|---|
| A compound having the following general structure: bis($(C_2H_5O)(C_2H_4O)n)(CH_3)$—$N^+$—$C_xH_{2x}$—$N^+$—$(CH_3)$-bis($(C_2H_5O)(C_2H_4O)n$), wherein n = from 20 to 30, and x = from 3 to 8, or sulphated or sulphonated variants thereof | 1.0 | 0.5 | 0.75 | 1.0 |
| Sodium Percarbonate | — | 15 | 17.5 | 14 |
| TAED (tetraacetylethylenediamine) | — | 3 | 2.3 | 1.6 |
| Carboxymethyl cellulose | 0.5 | 1.0 | 1.5 | 1.0 |
| Ethylene diamine disuccinic acid | 0.05 | 0.1 | 0.2 | 0.15 |
| Magnesium sulphate | 0.35 | 0.1 | 1.0 | 0.25 |
| Hydroxyethane di(methylene phosphonic acid) | 0.1 | 0.25 | 0.2 | 0.5 |
| Fluorescent whitening agent | 0.2 | 0.1 | 0.15 | 0.25 |
| Silicone suds suppressing agent | 0.1 | 0.05 | 0.1 | 0.2 |
| Soap | 0.5 | 0.25 | 1.0 | 0.5 |
| Photobleach | 0.01 | 0.0001 | 0.0005 | 0.0015 |
| Perfume | 1.0 | 0.5 | 0.75 | 0.5% |
| Sodium sulphate | 45 | 30 | 20 | 22 |
| Water and miscellaneous | to 100% | to 100% | to 100% | to 100% |

The following laundry detergent compositions I, J, K and L are suitable for use in the present invention. They are also suitable for use with front-loading washing machines

| Ingredient | I | J | K | L |
|---|---|---|---|---|
| Bleach catalyst made according to example 1 or 2 | 0.15 | 0.10 | 0.01 | 0.05 |
| Endoglucanase† (15.6 mg/g active) | 0.2 | 0.1 | 0.3 | 0.05 |
| Savinase* 32.89 mg/g | 0.1 | 0.2 | 0.3 | 0.5 |
| Natalase* 8.65 mg/g | 0.2 | — | 0.1 | — |
| Lipex* 9 mg/g | 0.5 | 0.3 | — | 0.1 |
| Sodium linear $C_{12-13}$ alkyl benzenesulphonate (LAS) | 15 | 17.5 | 20 | 10.0 |
| $C_{14-15}$ alkyl ethoxylated alcohol sulphate having an average degree of ethoxylation of 3 ($AE_3S$) | 7.0 | 7.5 | 5.0 | 5.0 |
| Citric Acid | 7.0 | 5.0 | 7.5 | 3.0 |
| Sodium Percarbonate | 20 | 15 | — | 14 |
| TAED (tetraacetylethylenediamine) | 2.5 | 3 | — | 1.6 |
| NOBS (nonanoyloxybenzene sulphonate) | 0.0 | 2.0 | — | — |
| Oxone ® | — | — | 3.0 | — |
| Sodium carbonate | 22.5 | 25 | 20 | 10 |
| Polycarboxylate Sokalan ® CP5 ex BASF | 7.0 | 7.5 | 5.0 | 3.0 |
| A compound having the following general structure: bis($(C_2H_5O)(C_2H_4O)n)(CH_3)$—$N^+$—$C_xH_{2x}$—$N^+$—$(CH_3)$-bis($(C_2H_5O)(C_2H_4O)n$), wherein n = from 20 to 30, and x = from 3 to 8, or sulphated or sulphonated variants thereof | 2.5 | 1.5 | 3.0 | 1.0 |
| Carboxymethyl cellulose | 2.5 | 3.0 | 1.5 | 1.0 |
| Ethylene diamine disuccinic acid | 0.25 | 0.1 | 0.5 | 0.15 |
| Hydroxyethane di(methylene phosphonic acid) | 0.5 | 0.75 | 0.25 | 0.2 |
| Fluorescent whitening agent | 0.5 | 0.75 | 0.25 | 0.15 |
| Silicone suds suppressing agent | 0.05 | 0.10 | 0.02 | 0.02 |
| Photobleach | 0.025 | 0.050 | 0.02 | 0.0015 |
| Water, filler (including sodium sulphate) and miscellaneous | to 100 | to 100 | to 100 | to 100 |

Bleaching detergent compositions having the form of granular laundry detergents are exemplified by the following formulations. Any of the below compositions is used to launder fabrics at a concentration of 600-10000 ppm in water, for example in a top loading washing machine or handwash process.

| | M | N | O | P | Q | R |
|---|---|---|---|---|---|---|
| Linear alkylbenzenesulfonate | 20 | 22 | 20 | 15 | 20 | 20 |
| $C_{12}$ Dimethylhydroxyethyl ammonium chloride | 0.7 | 1 | — | 0.6 | — | 0.7 |
| AE3S | 0.9 | — | 0.9 | — | — | 0.9 |
| AE7 | — | 0.5 | — | 1 | 3 | 1 |
| sodium tripolyphosphate | 23 | 30 | 23 | 17 | 12 | 23 |
| Zeolite A | — | — | — | — | 10 | — |
| 1.6R Silicate | 7.0 | 6.2 | 7 | 7 | 7 | 7 |
| Sodium Carbonate | 15 | 14 | 15 | 18 | 15 | 15 |
| Polyacrylate MW 4500 | 1 | — | 3 | 2 | 1.5 | 1 |
| Carboxy Methyl Cellulose | 0.2 | 0.1 | 1.0 | — | 0.2 | 0.15 |
| Endoglucanase† (15.6 mg active) | 0.1 | 0.2 | 0.05 | 0.1 | 0.3 | 0.2 |
| Savinase* 32.89 mg/g | 0.1 | 0.07 | 0.1 | 0.1 | 0.1 | 0.1 |
| Natalase* 8.65 mg/g | 0.1 | 0.1 | 0.1 | — | 0.1 | 0.1 |
| Lipex* 18 mg/g | 0.03 | 0.07 | — | 0.1 | — | — |
| Tinopal ® AMS (ex. Ciba) | 0.06 | — | 0.06 | 0.18 | 0.06 | 0.06 |
| Tinopal ® CBS-X (ex. Ciba) | 0.1 | 0.06 | 0.1 | — | 0.1 | 0.1 |
| Diethylenetriamine pentacetic acid | 0.6 | 0.3 | 0.6 | 0.25 | 0.6 | 0.6 |
| $MgSO_4$ | 1 | 1 | 1 | 0.5 | 1 | 1 |
| Sodium Percarbonate | — | 5.2 | 0.1 | — | — | — |
| Photobleach | 0.0030 | 0.0015 | 0.0015 | 0.0020 | 0.0045 | 0.0010 |
| Sodium Perborate Monohydrate | 4.4 | — | 3.85 | 2.09 | 0.78 | 3.63 |
| NOBS | 1.9 | — | 1.66 | — | 0.33 | 0.75 |
| TAED | 0.58 | — | 0.51 | — | 0.015 | 0.28 |
| Organic Catalyst** | 0.0185 | 0.0185 | 0.0162 | 0.0185 | 0.0111 | 0.0074 |
| Diacyl peroxide*** | — | 0.5 | — | 1.0 | — | — |
| Sulfate/Moisture | Balance to 100% | Balance to 100% | Balance to 100% | Balance to 100% | Balance to 100% | Balance to 100% |

†Endoglucanase is preferably Celluclean ®, supplied by Novozymes, Bagsvaerd, Denmark

*Enzymes supplied by Novozymes, Bagsvaerd, Denmark

**Organic catalyst prepared according to Examples 1 or 2 or mixtures thereof.

***Diacyl peroxide is preferably dinonanoylperoxide.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

SEQUENCE LISTING

```
<160> NUMBER OF SEQ ID NOS: 2

<210> SEQ ID NO 1
<211> LENGTH: 773
<212> TYPE: PRT
<213> ORGANISM: Bacillus sp.

<400> SEQUENCE: 1

Ala Glu Gly Asn Thr Arg Glu Asp Asn Phe Lys His Leu Leu Gly Asn
1               5                   10                  15

Asp Asn Val Lys Arg Pro Ser Glu Ala Gly Ala Leu Gln Leu Gln Glu
            20                  25                  30

Val Asp Gly Gln Met Thr Leu Val Asp Gln His Gly Glu Lys Ile Gln
        35                  40                  45

Leu Arg Gly Met Ser Thr His Gly Leu Gln Trp Phe Pro Glu Ile Leu
    50                  55                  60

Asn Asp Asn Ala Tyr Lys Ala Leu Ala Asn Asp Trp Glu Ser Asn Met
65                  70                  75                  80

Ile Arg Leu Ala Met Tyr Val Gly Glu Asn Gly Tyr Ala Ser Asn Pro
                85                  90                  95
```

```
Glu Leu Ile Lys Ser Arg Val Ile Lys Gly Ile Asp Leu Ala Ile Glu
            100                 105                 110

Asn Asp Met Tyr Val Ile Val Asp Trp His Val His Ala Pro Gly Asp
        115                 120                 125

Pro Arg Asp Pro Val Tyr Ala Gly Ala Glu Asp Phe Phe Arg Asp Ile
    130                 135                 140

Ala Ala Leu Tyr Pro Asn Asn Pro His Ile Ile Tyr Glu Leu Ala Asn
145                 150                 155                 160

Glu Pro Ser Ser Asn Asn Asn Gly Gly Ala Gly Ile Pro Asn Asn Glu
                165                 170                 175

Glu Gly Trp Asn Ala Val Lys Glu Tyr Ala Asp Pro Ile Val Glu Met
            180                 185                 190

Leu Arg Asp Ser Gly Asn Ala Asp Asp Asn Ile Ile Ile Val Gly Ser
        195                 200                 205

Pro Asn Trp Ser Gln Arg Pro Asp Leu Ala Ala Asp Asn Pro Ile Asn
    210                 215                 220

Asp His His Thr Met Tyr Thr Val His Phe Tyr Thr Gly Ser His Ala
225                 230                 235                 240

Ala Ser Thr Glu Ser Tyr Pro Pro Glu Thr Pro Asn Ser Glu Arg Gly
                245                 250                 255

Asn Val Met Ser Asn Thr Arg Tyr Ala Leu Glu Asn Gly Val Ala Val
            260                 265                 270

Phe Ala Thr Glu Trp Gly Thr Ser Gln Ala Asn Gly Asp Gly Gly Pro
        275                 280                 285

Tyr Phe Asp Glu Ala Asp Val Trp Ile Glu Phe Leu Asn Glu Asn Asn
    290                 295                 300

Ile Ser Trp Ala Asn Trp Ser Leu Thr Asn Lys Asn Glu Val Ser Gly
305                 310                 315                 320

Ala Phe Thr Pro Phe Glu Leu Gly Lys Ser Asn Ala Thr Asn Leu Asp
                325                 330                 335

Pro Gly Pro Asp His Val Trp Ala Pro Glu Glu Leu Ser Leu Ser Gly
            340                 345                 350

Glu Tyr Val Arg Ala Arg Ile Lys Gly Val Asn Tyr Glu Pro Ile Asp
        355                 360                 365

Arg Thr Lys Tyr Thr Lys Val Leu Trp Asp Phe Asn Asp Gly Thr Lys
    370                 375                 380

Gln Gly Phe Gly Val Asn Ser Asp Ser Pro Asn Lys Glu Leu Ile Ala
385                 390                 395                 400

Val Asp Asn Glu Asn Asn Thr Leu Lys Val Ser Gly Leu Asp Val Ser
                405                 410                 415

Asn Asp Val Ser Asp Gly Asn Phe Trp Ala Asn Ala Arg Leu Ser Ala
            420                 425                 430

Asp Gly Trp Gly Lys Ser Val Asp Ile Leu Gly Ala Glu Lys Leu Thr
        435                 440                 445

Met Asp Val Ile Val Asp Glu Pro Thr Thr Val Ala Ile Ala Ala Ile
    450                 455                 460

Pro Gln Ser Ser Lys Ser Gly Trp Ala Asn Pro Glu Arg Ala Val Arg
465                 470                 475                 480

Val Asn Ala Glu Asp Phe Val Gln Gln Thr Asp Gly Lys Tyr Lys Ala
                485                 490                 495

Gly Leu Thr Ile Thr Gly Glu Asp Ala Pro Asn Leu Lys Asn Ile Ala
            500                 505                 510
```

```
Phe His Glu Glu Asp Asn Asn Met Asn Asn Ile Ile Leu Phe Val Gly
        515                 520                 525

Thr Asp Ala Ala Asp Val Ile Tyr Leu Asp Asn Ile Lys Val Ile Gly
    530                 535                 540

Thr Glu Val Glu Ile Pro Val Val His Asp Pro Lys Gly Glu Ala Val
545                 550                 555                 560

Leu Pro Ser Val Phe Glu Asp Gly Thr Arg Gln Gly Trp Asp Trp Ala
                565                 570                 575

Gly Glu Ser Gly Val Lys Thr Ala Leu Thr Ile Glu Glu Ala Asn Gly
            580                 585                 590

Ser Asn Ala Leu Ser Trp Glu Phe Gly Tyr Pro Glu Val Lys Pro Ser
        595                 600                 605

Asp Asn Trp Ala Thr Ala Pro Arg Leu Asp Phe Trp Lys Ser Asp Leu
    610                 615                 620

Val Arg Gly Glu Asn Asp Tyr Val Ala Phe Asp Phe Tyr Leu Asp Pro
625                 630                 635                 640

Val Arg Ala Thr Glu Gly Ala Met Asn Ile Asn Leu Val Phe Gln Pro
                645                 650                 655

Pro Thr Asn Gly Tyr Trp Val Gln Ala Pro Lys Thr Tyr Thr Ile Asn
            660                 665                 670

Phe Asp Glu Leu Glu Glu Ala Asn Gln Val Asn Gly Leu Tyr His Tyr
        675                 680                 685

Glu Val Lys Ile Asn Val Arg Asp Ile Thr Asn Ile Gln Asp Asp Thr
    690                 695                 700

Leu Leu Arg Asn Met Met Ile Ile Phe Ala Asp Val Glu Ser Asp Phe
705                 710                 715                 720

Ala Gly Arg Val Phe Val Asp Asn Val Arg Phe Glu Gly Ala Ala Thr
                725                 730                 735

Thr Glu Pro Val Glu Pro Glu Pro Val Asp Pro Gly Glu Glu Thr Pro
            740                 745                 750

Pro Val Asp Glu Lys Glu Ala Lys Lys Glu Gln Lys Glu Ala Glu Lys
        755                 760                 765

Glu Glu Lys Glu Glu
    770


<210> SEQ ID NO 2
<211> LENGTH: 824
<212> TYPE: PRT
<213> ORGANISM: Bacillus sp.
<220> FEATURE:
<223> OTHER INFORMATION: KSM-S237

<400> SEQUENCE: 2

Met Met Leu Arg Lys Lys Thr Lys Gln Leu Ile Ser Ser Ile Leu Ile
1               5                   10                  15

Leu Val Leu Leu Leu Ser Leu Phe Pro Ala Ala Leu Ala Ala Glu Gly
            20                  25                  30

Asn Thr Arg Glu Asp Asn Phe Lys His Leu Leu Gly Asn Asp Asn Val
        35                  40                  45

Lys Arg Pro Ser Glu Ala Gly Ala Leu Gln Leu Gln Glu Val Asp Gly
    50                  55                  60

Gln Met Thr Leu Val Asp Gln His Gly Glu Lys Ile Gln Leu Arg Gly
65                  70                  75                  80

Met Ser Thr His Gly Leu Gln Trp Phe Pro Glu Ile Leu Asn Asp Asn
                85                  90                  95
```

```
Ala Tyr Lys Ala Leu Ser Asn Asp Trp Asp Ser Asn Met Ile Arg Leu
            100                 105                 110

Ala Met Tyr Val Gly Glu Asn Gly Tyr Ala Thr Asn Pro Glu Leu Ile
        115                 120                 125

Lys Gln Arg Val Ile Asp Gly Ile Glu Leu Ala Ile Glu Asn Asp Met
    130                 135                 140

Tyr Val Ile Val Asp Trp His Val His Ala Pro Gly Asp Pro Arg Asp
145                 150                 155                 160

Pro Val Tyr Ala Gly Ala Lys Asp Phe Phe Arg Glu Ile Ala Ala Leu
                165                 170                 175

Tyr Pro Asn Asn Pro His Ile Ile Tyr Glu Leu Ala Asn Glu Pro Ser
            180                 185                 190

Ser Asn Asn Asn Gly Gly Ala Gly Ile Pro Asn Asn Glu Glu Gly Trp
        195                 200                 205

Lys Ala Val Lys Glu Tyr Ala Asp Pro Ile Val Glu Met Leu Arg Lys
    210                 215                 220

Ser Gly Asn Ala Asp Asp Asn Ile Ile Ile Val Gly Ser Pro Asn Trp
225                 230                 235                 240

Ser Gln Arg Pro Asp Leu Ala Ala Asp Asn Pro Ile Asp Asp His His
                245                 250                 255

Thr Met Tyr Thr Val His Phe Tyr Thr Gly Ser His Ala Ala Ser Thr
            260                 265                 270

Glu Ser Tyr Pro Ser Glu Thr Pro Asn Ser Glu Arg Gly Asn Val Met
        275                 280                 285

Ser Asn Thr Arg Tyr Ala Leu Glu Asn Gly Val Ala Val Phe Ala Thr
    290                 295                 300

Glu Trp Gly Thr Ser Gln Ala Ser Gly Asp Gly Gly Pro Tyr Phe Asp
305                 310                 315                 320

Glu Ala Asp Val Trp Ile Glu Phe Leu Asn Glu Asn Asn Ile Ser Trp
                325                 330                 335

Ala Asn Trp Ser Leu Thr Asn Lys Asn Glu Val Ser Gly Ala Phe Thr
            340                 345                 350

Pro Phe Glu Leu Gly Lys Ser Asn Ala Thr Asn Leu Asp Pro Gly Pro
        355                 360                 365

Asp His Val Trp Ala Pro Glu Glu Leu Ser Leu Ser Gly Glu Tyr Val
    370                 375                 380

Arg Ala Arg Ile Lys Gly Val Asn Tyr Glu Pro Ile Asp Arg Thr Lys
385                 390                 395                 400

Tyr Thr Lys Val Leu Trp Asp Phe Asn Asp Gly Thr Lys Gln Gly Phe
                405                 410                 415

Gly Val Asn Ser Asp Ser Pro Asn Lys Glu Leu Ile Ala Val Asp Asn
            420                 425                 430

Glu Asn Asn Thr Leu Lys Val Ser Gly Leu Asp Val Ser Asn Asp Val
        435                 440                 445

Ser Asp Gly Asn Phe Trp Ala Asn Ala Arg Leu Ser Ala Asn Gly Trp
    450                 455                 460

Gly Lys Ser Val Asp Ile Leu Gly Ala Glu Lys Leu Thr Met Asp Val
465                 470                 475                 480

Ile Val Asp Glu Pro Thr Thr Val Ala Ile Ala Ala Ile Pro Gln Ser
                485                 490                 495

Ser Lys Ser Gly Trp Ala Asn Pro Glu Arg Ala Val Arg Val Asn Ala
            500                 505                 510

Glu Asp Phe Val Gln Gln Thr Asp Gly Lys Tyr Lys Ala Gly Leu Thr
```

-continued

```
        515                 520                 525

Ile Thr Gly Glu Asp Ala Pro Asn Leu Lys Asn Ile Ala Phe His Glu
    530                 535                 540

Glu Asp Asn Asn Met Asn Asn Ile Ile Leu Phe Val Gly Thr Asp Ala
545                 550                 555                 560

Ala Asp Val Ile Tyr Leu Asp Asn Ile Lys Val Ile Gly Thr Glu Val
                565                 570                 575

Glu Ile Pro Val Val His Asp Pro Lys Gly Glu Ala Val Leu Pro Ser
            580                 585                 590

Val Phe Glu Asp Gly Thr Arg Gln Gly Trp Asp Trp Ala Gly Glu Ser
        595                 600                 605

Gly Val Lys Thr Ala Leu Thr Ile Glu Glu Ala Asn Gly Ser Asn Ala
    610                 615                 620

Leu Ser Trp Glu Phe Gly Tyr Pro Glu Val Lys Pro Ser Asp Asn Trp
625                 630                 635                 640

Ala Thr Ala Pro Arg Leu Asp Phe Trp Lys Ser Asp Leu Val Arg Gly
                645                 650                 655

Glu Asn Asp Tyr Val Ala Phe Asp Phe Tyr Leu Asp Pro Val Arg Ala
            660                 665                 670

Thr Glu Gly Ala Met Asn Ile Asn Leu Val Phe Gln Pro Pro Thr Asn
        675                 680                 685

Gly Tyr Trp Val Gln Ala Pro Lys Thr Tyr Thr Ile Asn Phe Asp Glu
    690                 695                 700

Leu Glu Glu Ala Asn Gln Val Asn Gly Leu Tyr His Tyr Glu Val Lys
705                 710                 715                 720

Ile Asn Val Arg Asp Ile Thr Asn Ile Gln Asp Asp Thr Leu Leu Arg
                725                 730                 735

Asn Met Met Ile Ile Phe Ala Asp Val Glu Ser Asp Phe Ala Gly Arg
            740                 745                 750

Val Phe Val Asp Asn Val Arg Phe Glu Gly Ala Ala Thr Thr Glu Pro
        755                 760                 765

Val Glu Pro Glu Pro Val Asp Pro Gly Glu Glu Thr Pro Pro Val Asp
    770                 775                 780

Glu Lys Glu Ala Lys Lys Glu Gln Lys Glu Ala Glu Lys Glu Glu Lys
785                 790                 795                 800

Glu Ala Val Lys Glu Glu Lys Lys Glu Ala Lys Glu Glu Lys Lys Ala
                805                 810                 815

Val Lys Asn Glu Ala Lys Lys Lys
            820
```

What is claimed is:

1. A composition comprising:

(a) a bacterial alkaline enzyme exhibiting endo-beta-1,4-glucanase activity, wherein the enzyme comprises:

(i) an endoglucanase having the amino acid sequence of positions 1 to position 773 of SEQ ID NO:1 or a fragment thereof that has endo-beta-1,4-glucanase activity; or (iii) mixtures thereof; and (b) a bleach catalyst having a chemical structure corresponding to the chemical formula:

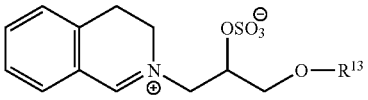

wherein $R^{13}$ is selected from the group consisting of: a branched alkyl group containing from 3 to 24 carbons, and a linear alkyl group containing from 1 to 24 carbons.

2. A composition according to claim 1 wherein the bacterial alkaline enzyme exhibiting endo-beta-1,4-glucanase activity is comprised at a level of from about 0.00005% to about 0.15% by weight of pure enzyme.

3. A composition according to claim 1 wherein the bleach catalyst is comprised at a level of from about 0.0005% to about 0.2% by weight of the composition.

4. A composition according to claim 1, wherein $R^{13}$ is selected from the group consisting of 2-butyloctyl, 2-pentylnonyl, 2-hexyldecyl, iso-tridecyl and iso-pentadecyl.

5. A composition according to claim 1 further comprising a source of peracid selected from the group consisting of:

a) an activated bleach system comprising a bleach activator;

b) a source of peroxide selected from the group consisting of (i) a preformed peracid;

(ii) a diacyl peroxide and a lipase;

(iii) a tetraacyl peroxide species and a lipase enzyme; and (iv) mixtures thereof c) mixtures of a) and b).

6. A composition according to claim 5 comprising an activated bleach system that comprises an oxybenzene sulphonate bleach activator and a source of peroxygen.

7. A composition according to claim 6, comprising a preformed peroxyacid.

8. A detergent composition according to claim 1 comprising from about 0.01 wt % to about 10 wt % of a chelant.

9. A detergent composition according to claim 1 comprising an optical brightener of the following structure, wherein $R_1$ and $R_2$, together with the nitrogen atom linking them, form an unsubstituted or $C_1$-$C_4$ alkyl-substituted morpholino, piperidine or pyrrolidine ring:

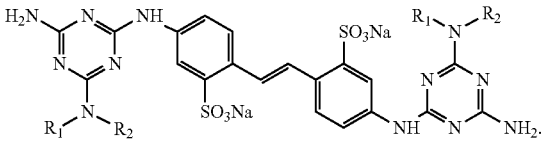

10. A detergent composition according to claim 1 further comprising a lipase enzyme.

11. A composition according to claim 1, wherein the composition comprises:

(a) less than about 5%, by weight of the composition, of zeolite builder;

(b) optionally, less than about 5%, by weight of the composition, of phosphate builder; and (c) optionally, less than about 5%, by weight of the composition, of silicate salt.

* * * * *